APPARATUS FOR PRODUCING MONOLITHIC CAST CONCRETE STRUCTURES

BACKGROUND OF THE INVENTION

1. Field of the Invention

The present invention is in the field of producing monolithic concrete modules, particularly in the form of inverted U shapes which may be combined to form a variety of building structures, and to apparatus for producing the same.

2. The Prior Art

As conducive to an understanding of the present invention, it is to be noted that the use of cast concrete building structures and subassemblies is increasing, due to the substantially lower cost thereof as contrasted with buildings fabricated by other methods, e.g. steel frames and curtain walls.

Numerous methods have been proposed for simplifying and expediting the formation of concrete modules in situ. The most commonly employed method involves the erection of wall forms of plywood, aluminum, etc., pouring of concrete therein to define vertical wall sections, aging of the cast wall sections until the same are structurally capable of supporting a load, stripping of the forms, subsequent positioning or casting of a slab member on the walls and the re-erection atop the slab of the wall forms for repetition of the steps hereinabove set forth.

As is well known, numerous disadvantages inhere in the procedures above described. Specifically, the forms used to cast concrete are typically expensive to rent and relatively time consuming to erect. The necessity for permitting such forms to remain in position until cure of the concrete has been substantially completed necessarily extends construction time, with attendant increased rental costs and labor costs.

Additionally, the subsequent positioning of a slab over a cured wall member results in a relatively weak joint or connection between the wall and the slab as compared, for instance, with a monolithically cast slab-wall construction.

In order to avoid the difficulties which inhere in the use of the standard construction systems above described, numerous attempts have been made to devise a practical and efficient means of forming in situ monolithic casting forms wherein at least two supporting side walls and slab may be simultaneously cast. Examples of the methods and apparatus created for such purpose are described in U.S. Pat. Nos. 3490,729; 3558,095; 3676,536; 3689,018; 3815,861; and 3822,853.

The methods and apparatuses as exemplified in the above referenced patents involve deficiencies of various sorts which have greatly hampered their commercial acceptance. A principal difficulty resides in the cumbersome and complex nature of the form mechanisms and their consequent great expense, together with the difficulty of positioning such forms, especially in multi-story building constructions.

SUMMARY

The present invention may be summarized as directed to an improved apparatus enabling the formation in situ of monolithic concrete modules and particularly modules comprising inverted U structures. The method is characterized by the simplicity and lightness of the forms required to be employed, the facility with which the same may be stripped and erected, and the relatively shorter period of time which the forms are required to remain in place.

More particularly, in accordance with the method of practicing the use of the apparatus of the present invention, the U-shaped monolithic cast concrete module is formed in situ by erecting spaced parallel forms for the casting of parallel vertical wall components. A slab nucleus is provided, the nucleus being rigid and structurally capable of supporting concrete topping which, together with the nucleus, will form the slab.

The nucleus is structurally supported at its terminal ends on the forms, which in turn are provided with means for withdrawing support for the nucleus when the wall has achieved sufficient structural stability.

The nucleus may be propped centrally, as desired, whereby in addition a camber may be introduced, if desired.

Concrete is then poured into the forms, and a topping poured over the nucleus, whereby a monolithic structure is defined.

After partial curing of the concrete, the forms may be stripped, leaving the nucleus and topping supported on the green but partially cured walls and, if desired, on the propping. Importantly, the degree of cure necessary to be attained by the concrete prior to stripping is substantially less than that required where a precast concrete slab is to be positioned, whereby stripping is facilitated and form utilization increased.

For instance, in the conventional method a wall cure period of four or more days may be required before it is feasible to emplace or cast a slab section. In accordance with the method of using the apparatus of the present invention, the wall forms may be stripped and reused in two days.

In order better to understand the feasibility of removing the forms at an earlier stage, it should be recognized that the emplacement of a preformed slab involves subjecting areas of the partially cured wall to extreme localized pressure, i.e. when the slab is lowered into position, initial contact between the slab and wall may be localized. Such localized contact would subject the contacted area to pressures many times the pressures to which the same areas would be subjected if the weight of the slab were equally distributed.

Additionally, propping of a conventional slab can be carried out only after the same has been positioned, whereas in accordance with the method for using the apparatus of the present invention the far lighter slab nucleus is structurally supported on the wall forms and propped prior to pouring of the walls and topping of the nucleus.

The invention is more particularly directed to an improved wall form device especially adapted for use in connection with the above described method. The wall form device includes spaced parallel rigid members or panels defining the boundaries of the casting cell for the wall. The uppermost edge portion of at least one of the walls of the cell is provided with a support bar extending substantially the length of the form and defining the uppermost boundary of the form on which the slab nucleus is to rest.

The support bar, in turn, is mounted on a retractor mechanism which enables the bar to be shifted downwardly and inwardly, whereby the weight of the nucleus and cured topping is smoothly relieved from the bar and form components and transferred exclusively to the partially cured concrete contained within the cell, enabling the facile removal of the form for reuse.

CONCRETE FLOOR FORMING SYSTEM

This is a continuation of application Ser. No. 519,561, filed Oct. 31, 1974, now abandoned.

BACKGROUND AND SUMMARY OF THE INVENTION

This invention relates to concrete forming systems, and more particularly to an improved system for fabricating concrete floors.

At the present time, concrete floors for buildings and the like are often fabricated utilizing forms or pans having an inverted U-shaped cross-section. The forms are positioned adjacent one another on wooden shoring members, and concrete is poured over the forms. The uppermost portion of the resulting concrete structure forms the floor per se, while the portions of the concrete structure extending between the forms comprise floor supportive beams. Following the concrete forming operation, the shoring members and the forms are disassembled and are stored for reuse.

This type of concrete forming system has proven to be both practical and economical, and has therefore gained relatively wide-spread acceptance. However, notwithstanding the commercial success of the process, a number of problems have been encountered in its use. For example, the forms which are presently commercially available are supported on the shoring members in such a way that the distance between the tops of the forms and the shoring members is fixed. This in turn means that the height of the beams of the resulting concrete floor structure is also fixed. It is therefore necessary to provide a different set of forms if a different beam height is desired. This is not only costly from the standpoint of purchasing the forms, but also from the standpoint of storing the different sets of forms between uses.

Another problem that is involved in the use of the forms that are presently available commercially relates to the fact that the forms are adapted to be joined together by fitting the end of one form over the end of the next adjacent form. The resulting joint between the forms may be considered as a lap joint and is unsatisfactory due to the fact that it forms a ridge in the resulting concrete structure. Also, concrete tends to flow into the space between the two forms during operation. In certain instances this can lead to difficulty in disassembling the forms.

Problems have also been encountered with respect to the shoring members that are utilized to support the forms. At the present time an undue amount of lumber is required in order to fabricate the shoring members. This is costly, both from the standpoint of initial costs and from the standpoint of storage costs. Also, the wooden shoring members utilized in presently available concrete forming systems are not readily adapted to stacking, leading to additional difficulty and expense with respect to storage of the shoring members.

The present invention comprises a concrete forming system which overcomes the foregoing and other disadvantages long since associated with the prior art. In accordance with the broader aspects of the invention, there is provided a plurality of forms each having a substantially planar upper wall extending to curved shoulders at each edge. Side walls depend from the curved shoulders and comprise upper outwardly tapered portions to facilitate removal of the forms following a concrete forming operation and lower portions extending perpendicularly to the upper wall and parallel to each other. Longitudinally spaced sets of holes are formed in the side walls, with each set including at least two vertically spaced holes formed in the lower portions of the side walls. The forms are secured to wooden shoring members by means of fasteners extending through the holes in the side walls, with the positioning of the upper walls of the forms relative to the shoring members depending on the particular hole of each set that receives the fastener. The fasteners preferably comprise double-headed nails to facilitate subsequent disassembly of the forms.

In accordance with other aspects of the invention, each form has a lip extending from one end thereof. The lip extends along the inner periphery of the upper wall and the side walls of the form, and is adapted to receive and support the opposite end of an adjacent form. There is thus provided a butt joint between adjacent forms which is advantageous in that it does not result in a ridge in the resulting concrete structure, and further in that it provides concrete from flowing into the space between the forms.

In accordance with still other aspects of the invention, the forms are supported on shoring members comprising wooden stringers extending between adjacent forms. The stringers have longitudinally spaced apertures formed therein. The stringers are in turn supported by post shores which are adjustable as to height. The post shores have locating pins extending from the upper ends thereof which are received in the apertures of the stringers. This not only facilitates assembly and disassembly of the shoring members, but also accommodates stacking of the shoring members between uses.

DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
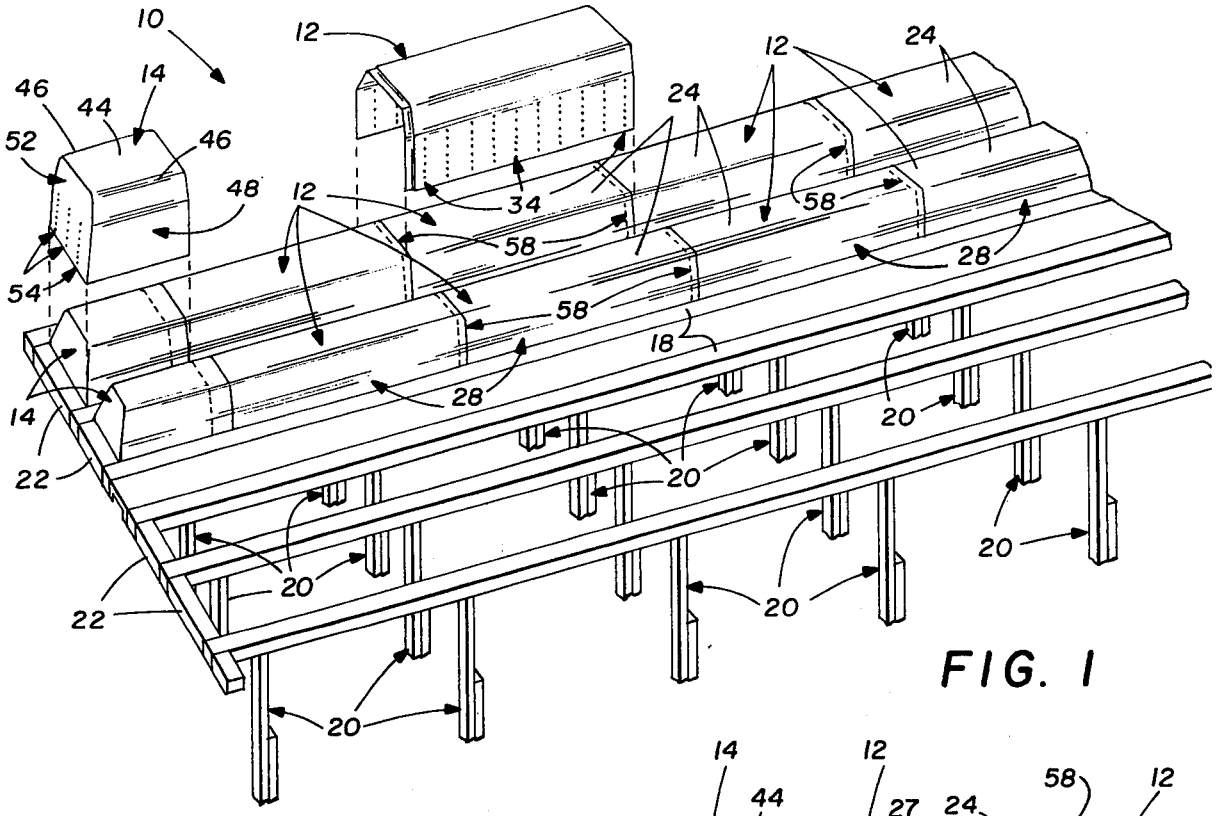
FIG. 1 is an illustration of a concrete forming system incorporating the invention.

Referring now to the Drawings, and particularly to FIG. 1 thereof, there is shown a concrete forming system 10 incorporating the present invention. The concrete forming system 10 utilizes a plurality of forms 12 and a plurality of end caps 14 in the construction of concrete floors. The forms 12 and the end caps 14 are supported by a shoring system 16 including a plurality of stringers 18 which extend adjacent to the forms 12 and the end caps 14. The stringers 18 are in turn supported by a plurality of post shores 20. The ends of the stringers 18 are interconnected by end members 22.

Figure 2:
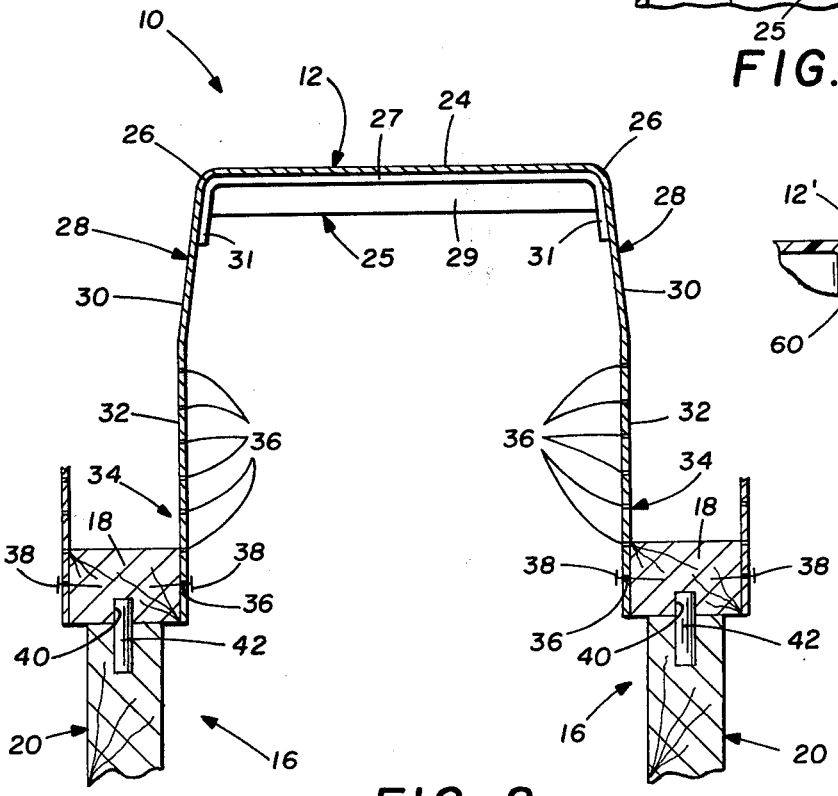
FIG. 2 is a transverse sectional view further illustrating the invention.

Referring to FIG. 2, each form 12 of the concrete forming system 10 comprises a substantially planar upper wall 24. The upper wall 24 extends to a pair of curved shoulders 26 which extend along the opposite edges of the upper wall 24 and substantially the entire length thereof. A pair of side walls 28 each depend from one of the shoulders 26. Each side wall 28 includes an upper outwardly tapered portion 30 which facilitates removal of the forms 12 from a finished concrete floor, and a lower portion 32. The lower portion 32 of the side walls 28 each extend substantially perpendicularly to the upper wall 24 and substantially parallel to each other.

The upper wall 24 of each form 12 is reinforced by longitudinally spaced reinforcing members 25. The members 25 comprise lengths of angle iron each having a flange 27 and a web 29. The members 25 are secured to the forms 12 by suitable means such as welding, and the flanges 27 include portions 31 which extend around the shoulders 26 and are secured to the side walls 28. By this means the load on the upper wall 24 is transferred to the side walls 28.

Figure 6:
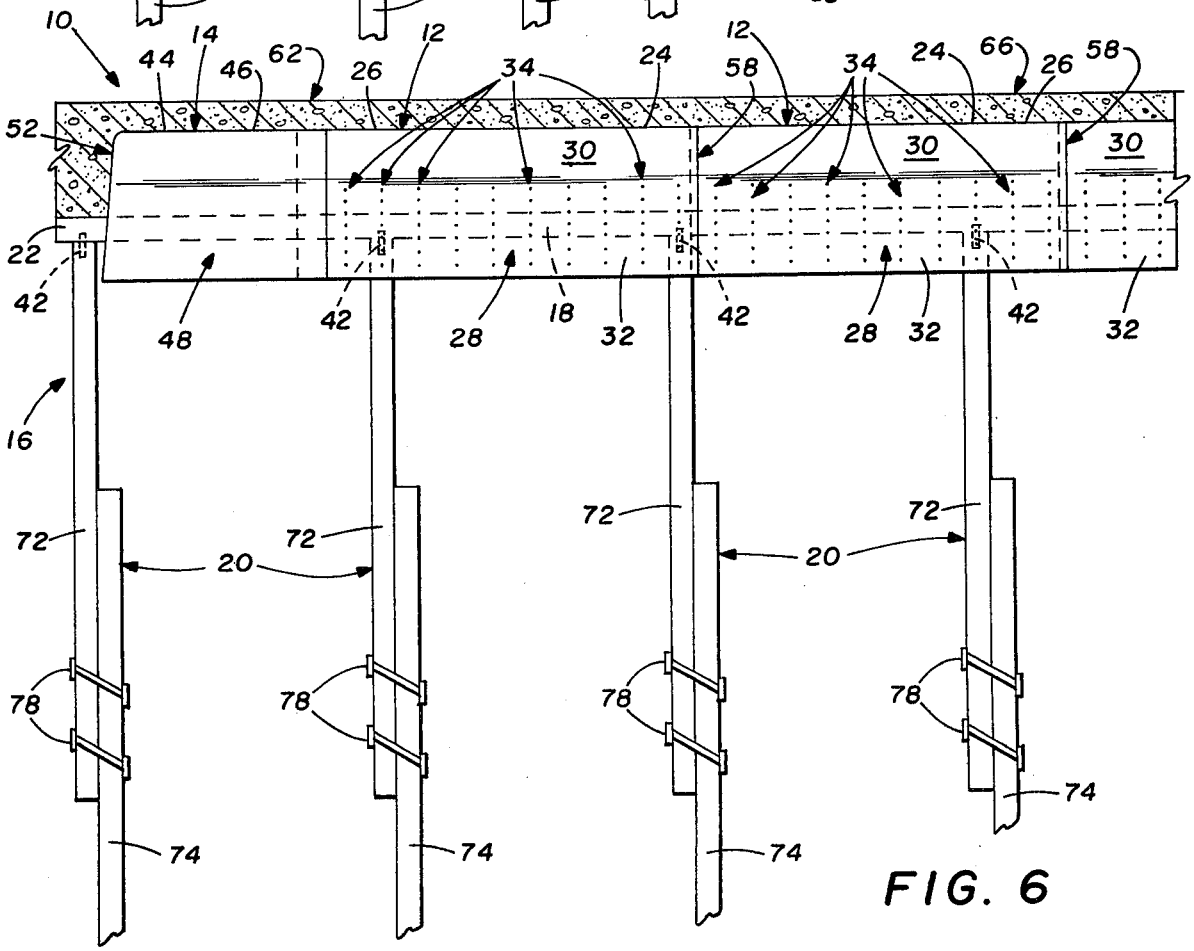
FIG. 6 is a further illustration of the use of the invention.

Referring momentarily to FIGS. 1 and 6, each side wall 28 of each form 12 comprises a plurality of longitudinally spaced sets of holes 34. As is best shown in FIG. 2, each set of holes 34 comprises a plurality of vertically spaced holes 36 formed through the perpendicularly extending portion 32 of the side wall 28. The forms 12 are supported on the stringers 18 of the shoring system 16 by means of fasteners inserted through the holes 36 and into the adjacent stringers 18. It will thus be understood that the positioning of the upper wall 24 of the form 12 depends on the particular hole 36 in the side walls 28 thereof that receive the fasteners.

Those skilled in the art will appreciate the fact that various commercially available fasteners may be received in the holes 36 to support the forms 12 on the stringers 18. The selection of the particular type of fasteners to be used will depend to some extent on the nature of the forms 12 and the nature of the stringers 18. In accordance with the preferred embodiment of the invention, the stringers 18 of the shoring system 16 are formed from wood, and the fasteners that are utilized to support the forms 12 on the stringers 18 comprise double-headed or duplex nails 38. This is to facilitate subsequent disassembly of the forms 12 from the stringers 18 after the concrete forming system 10 has been utilized in fabricating the concrete floor.

As has been indicated, the stringers of the shoring system 16 are preferably formed from wood so as to receive the double-headed nails 38. The post shores 20 of the shoring system 16 are also preferably formed from wood, as are the end members 22. Those skilled in the art will appreciate the fact that the shoring system 16 may also be fabricated utilizing metal post shores, various types of which are commercially available.

Each stringer 18 of the shoring system 16 is provided with a plurality of longitudinally spaced apertures 40. The upper end of each post shore 20 is provided with a locating pin 42. The shoring system 16 is thus assembled by positioning the post shores 20 under the stringers 18 with the locating pins 42 of the post shores 20 received in the apertures 40 of the stringers 18. This arrangement has been found to be highly advantageous in facilitating the rapid assembly of the shoring system 16. Moreover, the use of the apertures 40 and the locating pins 42 has been found to facilitate stacking of the component parts of the shoring system 16 during periods between uses thereof. For both of these reasons, substantial cost savings are realized in the use of a shoring system comprising stringers having locating pins depending therefrom and post shores having pin receiving apertures formed in the upper ends thereof when compared with prior art shoring systems.

Figure 3:
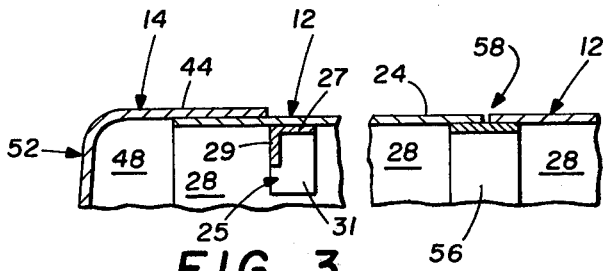
FIG. 3 is a longitudinal sectional view illustrating a first embodiment of the invention.

Referring to FIGS. 1 and 3, the construction of the end caps 14 is shown in detail. Each end cap 14 comprises a generally planar upper wall 44 extending to a pair of curved shoulders 46. The shoulders 46 in turn extend to a pair of side walls 48 which are substantially identical to the side walls 28 of the form 12, but lacking the holes 36 thereof. The upper wall 46 and the side walls 48 of each end cap 14 extend to an end wall 52. The end wall 52 is transversely disposed and thereby serves to close the otherwise open end of a string of forms 12. The end wall 52 is provided with sets of transversely spaced apart holes 54 arranged similarly to the holes comprising the sets 34, whereby fasteners may be inserted through the holes to secure the end caps 14 to the end members 22. Each end wall 52 is outwardly tapered to facilitate removal of the end cap 14 following a concrete forming operation.

Referring specifically to FIG. 3, the upper walls 44 and the side walls 48 of the end caps 14 are shaped similarly to the upper wall 24 and the side walls 28 of the form 12. However, the walls comprising the end caps 14 are dimensioned to receive the walls comprising the forms therein in the manner illustrated in FIG. 3. Each end cap 14 therefore receives the end of the adjacent form 12 in an overlapping relationship. This is advantageous in facilitating a desired relative longitudinal positioning between the end cap and the form.

FIG. 3 further illustrates the joints between adjacent forms 12 in the concrete forming system 10. One end of each form 12 has a lip 56 extending outwardly therefrom. The lip 56 extends around the interior surface of the end of the form 12 along the ends of the side walls 28 and the top wall 24. The lip 56 receives and supports the opposite end of the next adjacent form 12. By this means there is formed a butt joint 58 between adjacent forms 12. One advantage to the use of this type of joint between adjacent forms is that the exterior surfaces of adjacent forms extend substantially continuously across the joint, thereby eliminating any discontinuity in the interior surface of the concrete floor structure formed by means of the concrete forming system 10. Perhaps more importantly, the butt joint between adjacent forms of the present invention eliminates the problem of concrete flowing into the joint between adjacent forms.

The end cap 14 and the forms 12 illustrated in FIG. 3 are formed from metal. For example, the end cap and the forms of FIG. 3 may be formed from steel sheets. In such instances, the lip 56 may comprise a metal strip formed from steel or the like and secured to the interior of one end of one of the forms 12 by means of welding, or by means of suitable fasteners.

Figure 4:
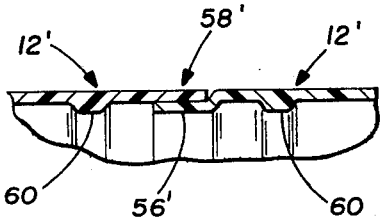
FIG. 4 is a longitudinal sectional view illustrating a second embodiment of the invention.

In FIG. 4, there is shown the opposite ends of a pair of forms 12'. The forms 12' are substantially identical in configuration to the forms 12 illustrated in FIG. 2, but are formed from a suitable plastic material, rather than metal. For example, the forms 12' may be fabricated from fiberglass. The forms 12' further differ from the forms 12 in that reinforcing ribs 60 may be formed integrally therewith.

One end of each form 12' is provided with an outwardly extending lip 56'. The lip 56' extends around the entire interior periphery of the form 12' and is adapted to receive and support the opposite end of the adjacent form 12′ thereby forming a butt joint 58′ therebetween. It will be noted that whereas the lip 56 of FIG. 3 comprises a separate member secured to the form 12 by suitable means, the lip 56′ is integrally formed with the form 12′. The lip 56 may also comprise a separate member secured to the form 12′ by suitable means.

Figure 5:
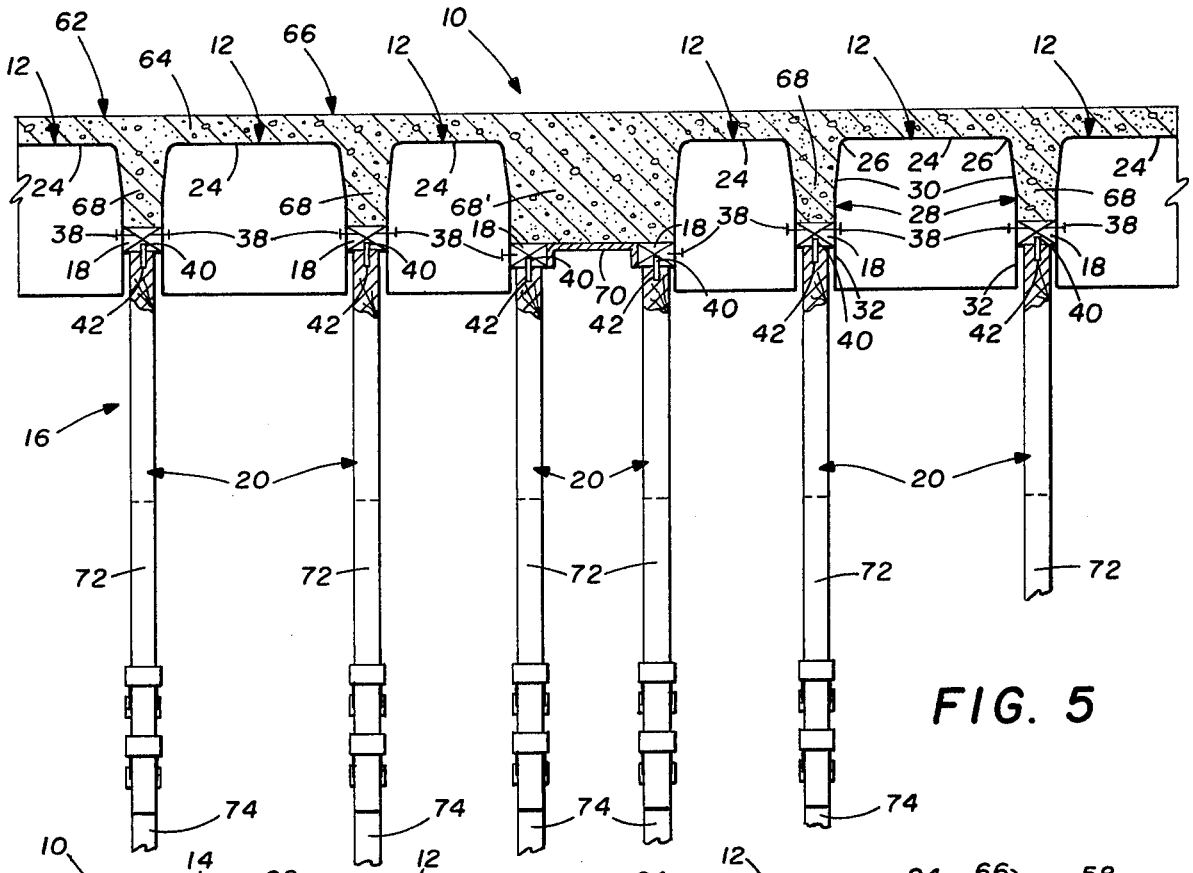
FIG. 5 is an illustration showing the use of the invention in forming a concrete floor.

The use of the present invention will be better understood by referring to FIGS. 5 and 6. The shoring system 16 is first erected. This is accomplished by positioning the locating pins 42 extending from the post shores 20 in the pin receiving apertures 40 formed in the stringers 18, and by connecting the end members 22 between the ends of the stringers 18. Then the forms 12 and the end caps 14 are mounted on the shoring system 16. This is accomplished by driving the doubleheaded nails 38 through selected holes 36 formed in the side walls 28 of the forms 12 and through the corresponding holes formed in the end wall of the end caps 14. It will be understood that the open ends of the end caps 14 are supported by the forms 12.

After the forms 12 and the end caps 14 are mounted on the shoring system 16, a quantity of concrete 62 is poured over the tops of the forms 12 and the end caps 14 and over the tops of the stringers 18 positioned between the forms and the end caps. The upper portion 64 of the quantity of concrete 62, and particularly the upper surface 66 thereof, forms the floor per se. The portions 68 of the quantity of concrete 62 extending between the forms 12 and the end caps 14 form beams which support the floor. As will be apparent by reference to FIG. 5, the various forms 12 and end caps 14 utilized in a particular concrete forming system 10 incorporating the invention need not be equal in width. Rather, the widths of the various forms and end caps which are utilized in the practice of the invention depend on the necessary spacing between adjacent beams as determined by engineering calculations. In the event a wider beam such as the beam 68′ of FIG. 5 is desired, a spacer 70 formed from plywood or the like is mounted between adjacent stringers 18. Wide beams of this type are typically formed in the floor at areas corresponding to columns extending between adjacent floors. As is clearly shown in FIG. 5, such beams 68′ need not be equal in height to the beams 68, but may be equal to, greater than or less than the height of the beams 68, as required by particular circumstances.

A very important feature of the present invention is illustrated in FIGS. 2 and 5. In FIG. 2, the form 12 is shown supported in the stringers 18 by means of double-headed or duplex nails 38 extending through the lowermost holes 36 formed in the perpendicularly extending portions 32 of the side walls 28. This arrangement provides maximum spacing between the tops of the stringers 18 and the upper walls 24 of the forms 12, and therefore maximum beam height. In FIG. 5, the forms 12 are secured to the stringers 18 by means of double-headed or duplex nails 38 received through the uppermost holes 36 formed in the perpendicularly extending portions 32 of the side walls 28. This provides minimum spacing between the upper surfaces of the stringers 18 and the upper walls 24 of the forms 12, and thereby provides minimum beam height in the resulting floor structure. It will thus be apparent that the height of the beams in the resulting floor structure depends directly upon the holes 36 formed in the perpendicularly extending portions 32 of the side walls 28 which receive the fasteners to secure the forms to the stringers. This in turn depends on the results of engineering calculations to determine the necessary beam height that is required for the particular floor under construction.

After the quantity of concrete 62 has set, the forms 12 and the end caps 14 are removed. This is accomplished with relative simplicity by means of the double-headed or duplex nature of the nails 38. Moreover, the upper outwardly tapered portions 30 of the side walls 28 of the forms 12 assure that the forms 12 are easily removed from the hardened concrete structure. Similarly, the tapered upper portions of the side walls 48 together with the tapered end wall construction of the end caps 14 facilitate the removal of the end caps from the hardened concrete structure.

Following removal of the forms 12 and the end caps 14, the shoring system 16 is disassembled. This is easily accomplished by simply disengaging the locating pins 42 of the post shores 20 from the apertures 40 of the stringers 18, and by disengaging the end members 22 from the stringers 18. The disassembled components of the shoring system 16 are then stacked prior to use in connection with the construction of another floor. It has been found that the nature of the connections between the stringers 18 and the post shores of the shoring system 16 is also advantageous in facilitating stackage and storage.

FIG. 6 illustrates the construction of the post shores 20 of the shoring system 16. Each post shore 20 comprises an upper section 72 and a lower section 74 both of which are formed from wood. The upper and lower sections are received through one or more metal brackets 78. In the use of the shoring system 16, the upper and lower sections are longitudinally adjusted in the brackets 78 until the desired vertical height of the post shore 20 is achieved. Nails are then employed to fix the position of the wooden members relative to the bracket. By this means the component parts of the post shore are secured with the upper end thereof being positioned at the desired height. The construction of the bracket is such that when a load is applied to the upper end of the post shore, the connection between the wooden members and the bracket tends to tighten, thus preventing slippage. Brackets of this type are commercially available.

From the foregoing, it will be understood that the present invention comprises a concrete forming system incorporating numerous advantages over the prior art. In one aspect, the use of the invention is advantageous in that concrete floors having beams of various heights may be fabricated utilizing the same set of forms and end caps. Another advantage to the use of the invention involves the fact that butt joints are formed between adjacent forms, thereby preventing the formation of ridges in the resulting concrete structure and preventing concrete from flowing into the joint between adjacent forms. Still another advantage to the use of the invention involves the fact that the component parts of the shoring system which is utilized to support the forms and end caps are readily and easily disassembled, and are adapted to convenient stackage and storage between uses.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

I claim:

1. A concrete forming system comprising:

a plurality of forms each having a substantially planar upper wall extending to curved shoulders at each edge thereof and side walls depending from the shoulders and each including an upper outwardly tapered portion extending to a lower portion with the lower portions of the side walls of each form extending parallel to each other and perpendicularly to the upper wall;

the upper wall and the side walls of each form extending to open ends with an integral lip extending from one end thereof with the outer surface of the lip being substantially aligned with the inner surface of the walls and shoulders of the forms such that the lip receives and supports the opposite end of an adjacent form to position the outer surfaces of the upper walls and the side walls of the adjacent forms in substantial alignment across the joint therebetween;

a plurality of end caps each having an upper wall and side walls which are similar in cross-section to the upper wall and the side walls of the forms and extending to a transversely disposed outwardly tapered end wall, said end caps receiving the forms therein;

the side walls of the forms and end caps each having at least one set of holes formed therethrough with each set of holes including at least two vertically spaced holes formed through the lower portion of the side wall;

a plurality of wooden stringers each extending adjacent to the side wall of at least one form and each stringer having a plurality of equally spaced locating pin receiving apertures formed therein in spaced relation one from the other along the length thereof;

a plurality of nails each extending through at least one of the holes of each set of holes in the side wall of the form and end caps and into the wooden stringer extending adjacent thereto for supporting the form on the stringer; and a plurality of post shores supporting the stringers and having locating pins extending from the upper ends thereof in engagement with the apertures of the stringers, thereby supporting the form secured thereto.

2. A concrete forming system comprising:

a plurality of forms each having a substantially planar upper wall extending to a pair of curved shoulders and a pair of side walls each depending from one of the shoulders and each comprising an upper outwardly tapered portion and a lower portion extending perpendicularly to the upper wall;

the upper wall and the side walls of each form extending to open ends with one end of each form having an integrally formed outwardly projecting interconnecting lip extending around the ends of the upper wall and side walls with the outer surface of the lip being aligned with the inner surface of the upper and side walls of the forms such that the lip receives and supports the opposite end of an adjacent form with the outer surfaces of the upper walls and the side walls of the two forms extending substantially continuously across the joint therebetween;

each of the forms having at least two longitudinally spaced sets of holes formed through each side wall thereof with the holes of each set including at least two vertically spaced holes extending through the lower perpendicularly disposed portion of the side wall;

integral reinforcing ribs extending transversely from the inner surface of the forms at spaced longitudinal points;

a plurality of end caps each having an upper wall, curved shoulders, and side walls dimensioned to reveive the upper wall, the shoulders, and the side walls of the forms therein and a transversely extending end wall whereby the end caps close the open ends of the forms;

a plurality of wooden stringers each extending between the side walls of a pair of adjacent forms;

a plurality of nails extending through the holes in the side walls of the forms and into the adjacent stringers to support the forms on the stringers with the positioning of the upper walls of the forms relative to the stringers depending on the hole of each set that receives the nail;

a plurality of post shores supporting the stringers and the forms supported thereby with each post shore having a locating pin extending therefrom, the post shore including means for adjusting the height thereof; and each of the stringers having a plurality of equally spacer apertures formed therein along the longitudinal length thereof receiving the locating pins of the post shores.

3. The concrete forming system according to claim 2 wherein the forms are molded with the interconnecting lips and reinforcing ribs integral with the upper and side walls.

* * * * *

UNITED STATES PATENT OFFICE

CERTIFICATE OF CORRECTION

Patent No. 4,023,765 Dated May 17, 1977

Inventor(s) James Robert Kinnamon

It is certified that error appears in the above-identified patent and that said Letters Patent are hereby corrected as shown below:

Col 2, Line 21, "provides" should be --prevents--.
Col 5, line 5, "56" should be --56'--.

Signed and Sealed this

*second* Day of *August 1977*

[SEAL]

*Attest:*

RUTH C. MASON
*Attesting Officer*

C. MARSHALL DANN
*Commissioner of Patents and Trademarks*